United States Patent [19]

Basil, Jr. et al.

[11] Patent Number: 4,736,173

[45] Date of Patent: Apr. 5, 1988

[54] THERMALLY-COMPENSATED MICROWAVE RESONATOR UTILIZING CURRENT-NULL SEGMENTATION

[75] Inventors: Richard V. Basil, Jr., Chatsworth; Juri G. Leetmaa, Los Angeles, both of Calif.

[73] Assignee: Hughes Aircraft Company, Los Angeles, Calif.

[21] Appl. No.: 924,113

[22] Filed: Nov. 3, 1986

Related U.S. Application Data

[63] Continuation of Ser. No. 737,580, May 24, 1985, abandoned, which is a continuation-in-part of Ser. No. 509,572, Jun. 30, 1983, abandoned.

[51] Int. Cl.[4] ..... H01P 7/06

[52] U.S. Cl. ..... 333/229; 333/234; 333/232

[58] Field of Search ..... 333/227, 228, 231, 232, 333/233, 234, 235, 229

[56] References Cited

U.S. PATENT DOCUMENTS

| | | | |
|---|---|---|---|
| 2,109,880 | 3/1938 | Dow | 333/234 |
| 2,173,908 | 9/1939 | Kolster | 333/234 |
| 2,183,215 | 12/1936 | Dow | 333/234 |
| 2,500,417 | 3/1950 | Kinzer | 333/228 |
| 2,528,387 | 10/1950 | Niessen | 333/229 |
| 2,553,811 | 5/1951 | Carnine et al. | 333/234 |
| 2,600,225 | 6/1952 | Ehrenfried | 333/229 |
| 2,600,278 | 6/1952 | Smullin | 333/229 |
| 3,414,847 | 12/1968 | Johnson | 333/229 |
| 3,733,561 | 5/1973 | Johnson | 333/234 |
| 4,215,327 | 7/1980 | McCrea | 333/252 |
| 4,446,429 | 5/1984 | Froncisz et al. | 333/235 X |

FOREIGN PATENT DOCUMENTS

| | | | |
|---|---|---|---|
| 130118 | 11/1948 | Australia | 333/227 |
| 803287 | 9/1936 | France . | |
| 2342564 | 9/1977 | France . | |
| 959655 | 4/1980 | France . | |
| 7808556 | 2/1980 | Netherlands . | |
| 578911 | 7/1946 | United Kingdom . | |
| 603119 | 6/1948 | United Kingdom . | |

*Primary Examiner*—Eugene R. Laroche
*Assistant Examiner*—Benny Lee
*Attorney, Agent, or Firm*—S. M. Mitchell; M. J. Meltzer; A. W. Karambelas

[57] ABSTRACT

In a microwave resonator, a variable cavity-wall segmentation along the location of a propagational current null is employed for thermal-compensation purposes by utilizing it in conjunction with supplemental mechanisms which operate to counteract thermally-induced variations in the resonator's characteristic geometry. Because dimensional variations at a current null will have minimum impact on resonator coupling parameters, a variably-configured current-null segmentation serves in a minimal-impact fashion to absorb those thermally-induced dimensional variations which occur transverse to the null. Of the three specific mechanisms disclosed for variational counteraction in the typical context of a resonator having both longitudinal and transverse extent with respect to a propagational axis, the first is a thermally-invariant assembly which provides thermal stabilization by inhibiting variations in the resonator's characteristic longitudinal extent. The second is a thermally-responsive structure configured to provide thermal compensation by affirmatively introducing *longitudinal* variations which are inversely proportional to otherwise-uncompensated *transverse* variations. The third mechanism, which may be employed in conjunction with either of the other two and which may take the form of thermally-invariant inserts configured as part of the resonant cavity's longitudinal walls, provides a further degree of thermal stabilization by inhibiting thermally-induced variations in the resonator's characteristic transverse dimensions.

16 Claims, 3 Drawing Sheets

THERMALLY-COMPENSATED MICROWAVE RESONATOR UTILIZING CURRENT-NULL SEGMENTATION

This is a continuation of copending application Ser. No. 06/737,580, filed May 24, 1985, abandoned which is a continuation-in-part of application Ser. No. 06/509,572, filed June 30, 1983, abandoned.

BACKGROUND OF THE INVENTION

1. Field of the Invention

The invention relates in general to microwave resonators and in particular to techniques for compensating for thermally-induced dimensional variations in such resonators.

2. Description of the Prior Art

An important objective of current satellite-developmental efforts is an increase in net transmission power. A long-standing obstacle to the achievement of this objective has been the unavailability of practical means for dissipating, especially from the associated narrow-band, microwave tuning elements, the significant amounts of heat which are inherently generated in high-power operation.

The readily-available nature of materials such as aluminum which do in fact possess high coefficients of thermal conductivity and which hence would otherwise be capable of dissipating the generated heat has in the past not facilitated the overcoming of this obstacle. Because such materials tend to inherently possess a complementary high coefficient of thermal expansion, the resulting lack of dimensional stability has generally made them unacceptable for use in the fabrication of tuned elements in which frequency stability is an essential consideration.

The primacy of the frequency-stability requirement has caused the typical prior-art practice to be restricted to the use of temperature-invariant materials such as Invar, graphite composites and quartz, which while dimensionally stable, inherently possess poor heat-dissipation characteristics. The net result is that in restricted environments such as satellites, transmitter operation has usually been limited to low-power levels.

It is accordingly a primary aim of the present invention to facilitate the realization of a significant increase in available transmitter power levels by providing a stabilized mechanism for increasing the power-handling capability of the associated narrow-band tuned elements.

The prior-art approach has also been disadvantageous in that the typically-utilized dimensionally-stable materials are costly and possess structural characteristics which are not conducive to ease of manufacture. Furthermore, these prior-utilized materials are relatively heavy, an especially-undesirable property in the inherently-weight-sensitive satellite environment.

It is also an aim of this invention, therefore, to provide thermally-stabilized microwave tuned elements which are economical, readily-manufactured and lightweight.

To the extent that the prior materials have in fact been utilized for high-power operation, such operation has typically required the employment of cumbersome supplemental structures. These structures have included such expedients as heat-sink elements or even pressurized assemblies with forced-air circulation. Arrangements of this nature have been additionally disadvantageous for a number of reasons. First, even though the employment of such units has enabled satellite power levels to be increased beyond the typical 5-to-20-watt range, the increase has usually been into the vicinity of only 40 watts at best and even this has represented an extension to the limits of the utilized-materials' operational properties. What is desired in contrast is an increase into the 100-to-200 -watt range. Second, and in addition to giving rise to still-higher levels of cost, manufacturing complexity and net weight, the more-involved nature of the resulting overall mechanisms has further compounded the difficulties associated with attempting to either cascade the tuned elements or otherwise configure them so as to minimize net operational interference. Also inherently associated with this higher level of complexity has been a correspondingly-decreased level of net reliability.

It is a further aim of this invention, therefore, to provide thermally-stabilized, high-power microwave tuned elements of inherent structural simplicity, combinatorial facility and operational reliability.

It may be noted that because the concept of an efficient, economical and lightweight means for the dimensionally-stabilized thermal compensation of narrow-band tuned microwave elements is not limited in applicability to satellite environments, the present invention provides a means for generally decreasing the net operational complexity of such elements in other environments as well.

Another important objective of current satellite development is the provision of microwave tuning elements which are substantially dimensionally stable despite thermal changes in the satellite's environment. Dimensional stability is important because the dimensions of a microwave tuning element such as a microwave cavity substantially determine its frequency response. One earlier approach toward the achievement of dimensional stability is illustrated in the drawings of FIG. 3. This earlier approach provides a thermally invariant bar to substantially hold end plates disposed on opposite ends of a microwave cavity in substantially fixed positions relative to one another to thereby substantially prevent thermally induced variations in the longitudinal dimensions of the microwave cavity.

SUMMARY OF THE INVENTION

In accordance with the concepts of the present invention, a microwave resonator is generally provided with a variable cavity-wall segmentation along the location of a propagational current null. The described limitations of the prior art are overcome and the enumerated and other aims are achieved when the current-null segmentation is more-specifically configured both to absorb cross-null dimensional variations and also to contribute to the realization of thermal compensation when utilized in conjunction with supplemental mechanisms which operate to counteract thermally-inducted variations in the resonator's characteristic geometry.

A yet-more-specific aspect of the invention provides two such supplemental mechanisms for variational counteraction in the typical context of a resonator having both longitudinal and transverse extent with respect to a propagational axis. The first is a thermally-responsive structure configured to provide thermal compensation by introducing longitudinal variations which are inversely-proportional to otherwise-uncompensated transverse variations. The second mechanism, which may be employed in combination with the other mechanism and which may take the form of a thermally-responsive mechanism surrounding a portion of the resonator cavity and supporting a substantially thermally-invarient tuning element. Changes in the resonant frequency of the resonator due to thermally-induced variations in the resonator's characteristic geometry are compensated for by changing the extent to which the tuning element extends into the resonator cavity.

BRIEF DESCRIPTION OF THE DRAWINGS

Advantages and aims of the present invention will become apparent from a study of the following specification, especially when considered in conjunction with the accompanying drawings, in which.

DETAILED DESCRIPTION OF THE INVENTION

I. Invention Fundamentals

A. Current-null segmentation

Figure 1:
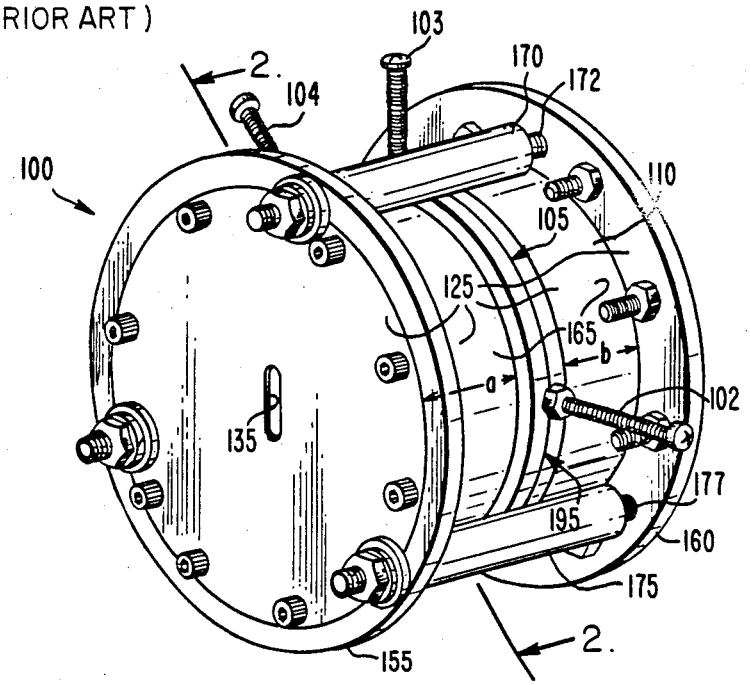
Fig. 1. (PRIOR ART)
FIG. 1 is a perspective view of a prior art microwave resonator which has been provided with a variable cavity-wall segmentation along the location of a propagational current-null for counteracting thermally-induced variations in characteristic geometry.

For the typical microwave resonator 100 of FIG. 1, there is provided a segmentation 105 in cavity 110. The segmentation is to be formed at the location of a null in the current-distribution pattern which conventionally appears throughout the walls 125 of cavity 110 when matched-frequency microwave energy propagates through the resonator upon being applied at an input aperture such as iris 135.

For a number of applications, it becomes convenient to more-particularly configure both cavity 110 and segmentation 105 such that the segmentation is physically variable in size.

An important operational consequence which follows from locating a variably-configured segmentation 105 at a current null of this nature is that cavity variations which take place at such a null will have minimum impact on resonator functioning. This is to be contrasted with the situation at the iris 135 which is deliberately configured to be located at a current maximum so that microwave coupling with adjacently-disposed devices is maximized.

It may be noted that although only one current null is assumed to be disposed, during microwave propagation, along walls 125, the actual number of nulls will tend to be a function of overall operating parameters. In a typical operational situation, several such nulls may be expected to appear.

B. Cavity specifics

For the sake of facilitating the presentation of more-specific inventive concepts discussed in subsequent portions of the specification, it further becomes convenient to explicitly identify various typically-inherent features of resonator 100. It is thus convenient to more-particularly describe cavity 110 as being defined by walls 125 which are dimensioned so as to establish the characteristic geometry of resonator 100. It may be noted parenthetically that, as is well-known, the concept of a characteristic geometry refers to those cavity-defining spatial dimensions which influence the resonator's resonant properties and propagational behavior.

In a yet-more-specific sense, cavity 110 is configured such that microwave energy, applied at input iris 135, is channeled along a propagational axis, with the cavity then possessing, with respect to this axis, characteristic longitudinal geometry and characteristic transverse geometry. Cavity walls 125 may likewise be more-specifically described as including transversly-disposed end plates 155 an 160, with the relative separation between these plates thereby establishing the resonator's associated characteristic longitudinal extent measured with respect to the propagational axis. Cavity walls 125 similarly include side walls 165, having in themselves an intrinsic longitudinal extent such as lengths "a" and "b." The separate identification of side walls 165 makes it possible to describe the segmentation 105 as being a substantially circular gap between the lengths "a" and "b" comprising the side walls 165. The segmentation 105 is substantially disposed between the end plates 155 and 160 about a longitudinal axis of the cavity 110 in a plane normal to the longitudinal axis. One will appreciate that the longitudinal axis of the cavity 110 also defines the path of current propagation within the cavity 110. It is with reference to the previously-presented comments concerning plural-null operation that it may also be noted parenthetically that although the illustrated current-null segmentation 105 is shown in FIG. 1 to be located at the longitudinal center of cavity 110, a non-central location, coinciding with a noncentrally-located one of a plurality of nulls, is in a readily apparent fashion within the scope of the present invention.

For the sake of even-more-specific aspects of the invention, cavity 110 may be described as having been configured such that the propagational axis is a substantially straight line. Furthermore, the end plates 155 and 160 may then be stipulated to be orthogonally-disposed with respect to this straight axis.

It may be noted further that there will be operational situations in which it is convenient to make explicit use of the conceptualization that the transverse configuration of the side walls 165 establishes resonator 100's associated characteristic transverse extent.

C. Thermal compensation

A current-null segmentation, such as the previously-described segmentation 105 in FIG. 1, may be employed to provide the associated microwave resonator with a thermal-compensation capability.

1. Characteristic Compensation

In the above-referenced more-specific situation where the resonator is described as possessing a cavity defined by dimensioned walls which establish the resonator's characteristic geometry and along which, during microwave propagation through the resonator, is disposed at least one current-null, thermal compensation is achieved by providing the resonator with a thermal-compensation mechanism which generally includes both a current-null segmentation and supplemental characteristic-compensation devices which are operatively associated with the cavity walls. The current-null segmentation 105 operates to absorb thermally-induced variations in wall dimensions, while the supplemental devices operate to counteract thermally-induced variations in the resonator's characteristic geometry. By virtue of the manner in which the segmentation 105 is configured, its variational absorption takes place along the cavity-wall location of the propagational current null at which the given segmentation 105 has been formed. The variations thus absorbed are those which tend to occur across the segmented current null.

Also previously described in part has been the manner in which the example resonator of FIG. 1 may be regarded as more-specifically possessing the features requisite for such thermal compensation. With respect to this example resonator, the thermal-compensation mechanism can be seen to more-specifically include the current-null segmentation 105 in conjunction with the schematically-illustrated characteristic-compensation devices 170 and 175. With segmentation 105 thus operating to absorb thermally-induced variations in the lengths of segments "a" and "b" of the sidewalls 165, the characteristic-compensation devices, which can be seen to be operatively associated with the end plates 155 and 160 of cavity walls 125, provide the required counteraction of thermally-induced variations in the characteristic geometry of the resonator 100. It may be noted that the illustrated example mechanization shows the devices 170 and 175 to be mounted exterior to cavity 110. Although an interior mounting is also possible, the exterior arrangement is preferred because it enables the cavity to remain free from internal obstructions which could otherwise adversely affect operational characteristics. (The deliberate insertion of tuning elements into the cavity will be separately discussed in a subsequent portion of the specification.)

Figure 2:
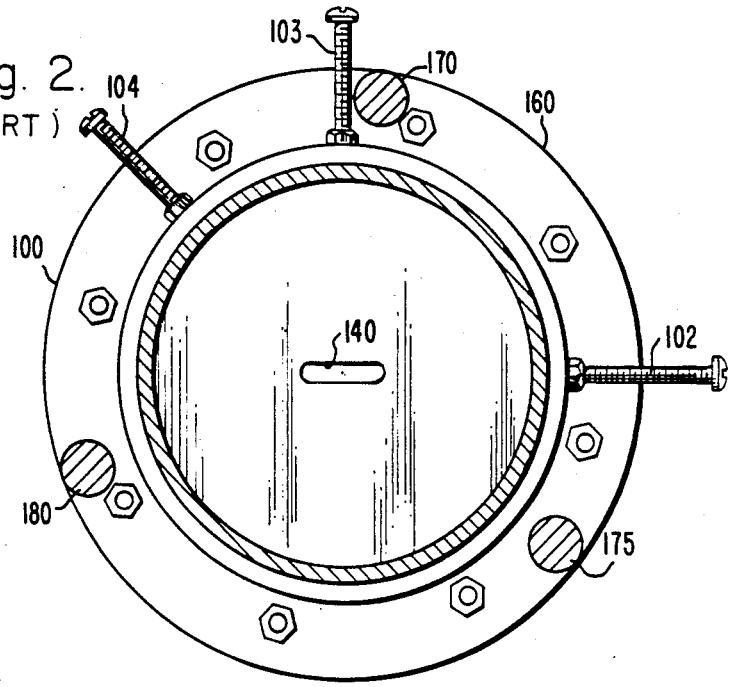
Fig. 2. (PRIOR ART)
FIG. 2 is a sectional view of the resonator of FIG. 1 taken along line 2—2.

It may also be noted that in the typical context of a resonator such as the cylindrical one of FIG. 1 in which the associated end plates 155 and 160 are configured to be mutually parallel, it will usually be advantageous to symmetrically dispose the characteristic-compensation devices around the periphery of the resonator. By means of this symmetrical disposition, the devices' net compensation effects are evenly distributed around the periphery, thus causing the otherwise-parallel relationship between the end plates to be maintained during thermal-variation counteraction. The reasonator 100 may thus be seen in the sectional view of FIG. 2 to include the three compensation devices 170, 175 and 180 symmetrically disposed at 120° intervals around the reasonator's periphery. It may be further noted parenthetically that the now-visible output iris 140 in end wall 160 will as illustrated typically be orthogonally oriented with respect to the input iris 135 shown in FIG. 1.

It is as a supplement to the previously-presented discussion of characteristic geometry that it should explicitly be noted in addition that the right-cylindrical geometry of the various illustrated resonators is to be regarded as exemplary only. It will be apparent that the concepts of the present invention are readily applicable to resonators having other types of transverse geometry, such as rectangular, and other types of longitudinal geometry, such as generally curvilinear. The present concepts could, for example, be utilized to provide a coaxial resonator with a thermal-compensation capability by means of an end wall having an adjacently-disposed variable current-null segmentation 105.

2. Alternative Realizations

In certain circumstances, the characteristic-stabilization devices generally described above may be more-specifically implemented in at least two different configurations. The first of these configurations provides the resonator with thermal stabilization by inhibiting thermally-induced variations in various aspects of the resonator's characteristic geometry. The second configuration in contrast affirmatively introduces characteristic variations which are inversely-proportional to those induced thermally.

a. Characteristic Stabilization:

In order to more-readily appreciate the manner in which this first more-specific configuration functions, it is convenient to discuss the configuration in the particularized context presented above in which the resonator is viewed as including at least the following four characteristics: First, the cavity is configured such that applied microwave energy is channeled along a propagational axis; second, the cavity possesses, with respect to this propagational axis, both characteristic longitudinal geometry and characteristic transverse geometry; third, the cavity walls include both (i) transversely-disposed end plates whose relative separation establishes the resonator's associated characteristic longitudinal extent and (ii) longitudinally-disposed side walls which have longitudinal extent; and fourth, at least one of the current nulls is a transverse null which is longitudinally disposed along the described side walls.

In this particularized context, the characteristic-compensation devices of the previously-presented thermal-compensation mechanism may be more specifically stipulated as including a thermally-nonresponsive, characteristic-stabilization mechanism which is operatively associated with the described transversely-disposed end plates and which operates to inhibit thermally-induced variations in the resonator's characteristic longitudinal extent. It is also in this context that (1) the thermal-compensation mechanism's current-null segmentation may be more-particularly specified as being included in the described side walls of said cavity walls and (2) those dimensional variations specified to be absorbed by the segmentation are longitudinal variations in the extent of the side walls. It may be noted that the segmentation would in this context be configured so that its absorption function is performed without in itself altering the characteristic longitudinal extent of the resonator.

Figure 3:
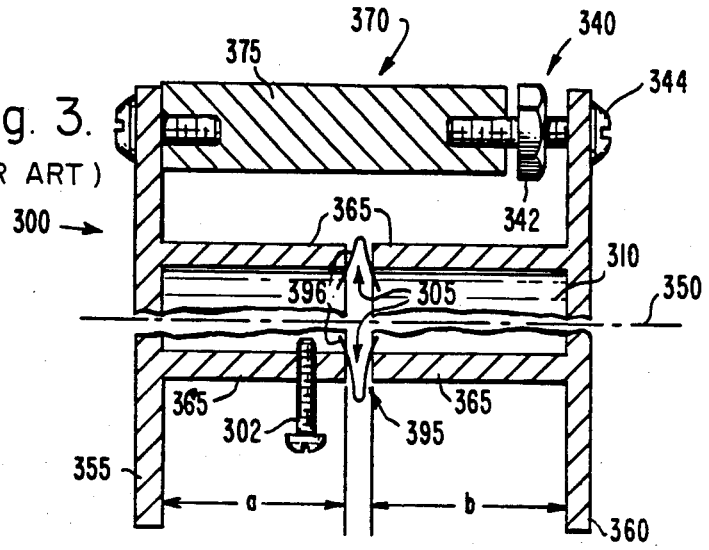
Fig. 3. (PRIOR ART)
FIG. 3 is a cross-sectional view of a prior art thermally-invariant bar assembly for inhibiting thermally-induced variations in the characteristic longitudinal extent of the resonator.

The drawings of FIG. 3 illustrate a prior art resonator 300 which uses a thermally stabilized bar assembly 370 to achieve some degree of dimensional stability despite changes in the thermal environment. The figure schematically presents a cross-sectional view of a thermally-compensated resonator 300. The illustrated resonator can be seen to be the more-specific form in which the four above-described particularized characteristics are present and in which cavity 310 is configured such that propagational axis 350 is a substantially straight line and end plates 355 and 360 are not only transversely-disposed with respect to the propagational axis but are more-specifically orthogonally-disposed with respect to this axis. In addition, the current-null segmentation 305 is seen to be included in side walls 365 so that the dimensional variations absorbed by segmentation 305 are, as required, variations in the side-wall dimensional extents "a" and "b" as measured longitudinally with respect to the axis 350.

In this very specific context, the characteristic stabilization mechanism encompasses thermally-stabilized bar assembly 370 which functions to hold end plates 355 and 360 in thermally-invariant characteristic longitudinal relationship. Furthermore, bar assembly 370 may be yet-more-particularly described as featuring a rod 375 composed of a thermally-nonresponsive material such as Invar, quartz or a suitable graphite composite.

Figure 4:
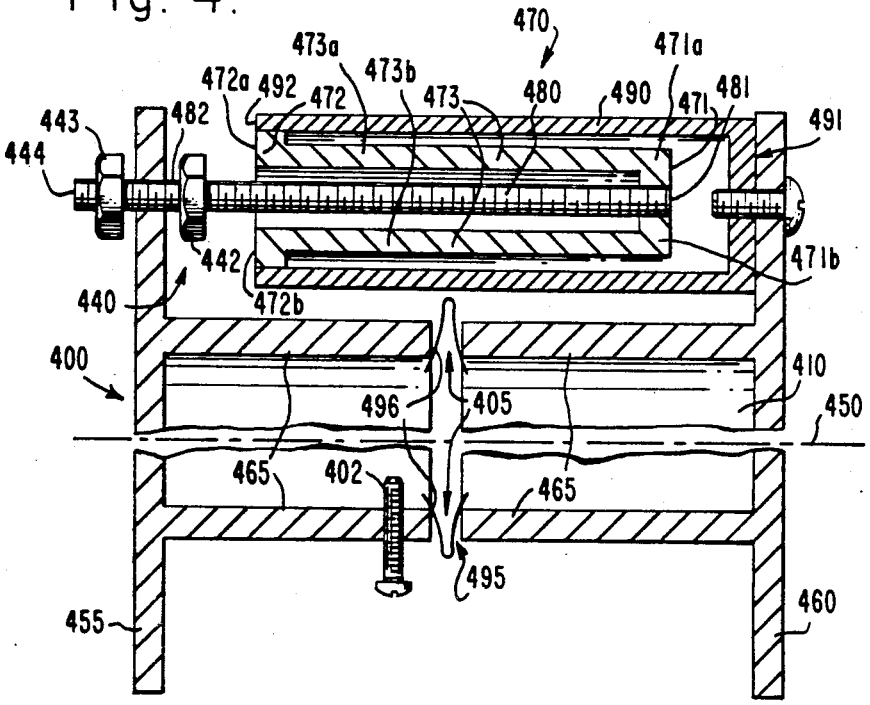
FIG. 4 is a cross-sectional view of a single-stage differential assembly which provides a resonator with longitudinal variations which are inversely proportional to thermally-induced transverse variations.
Figure 5:
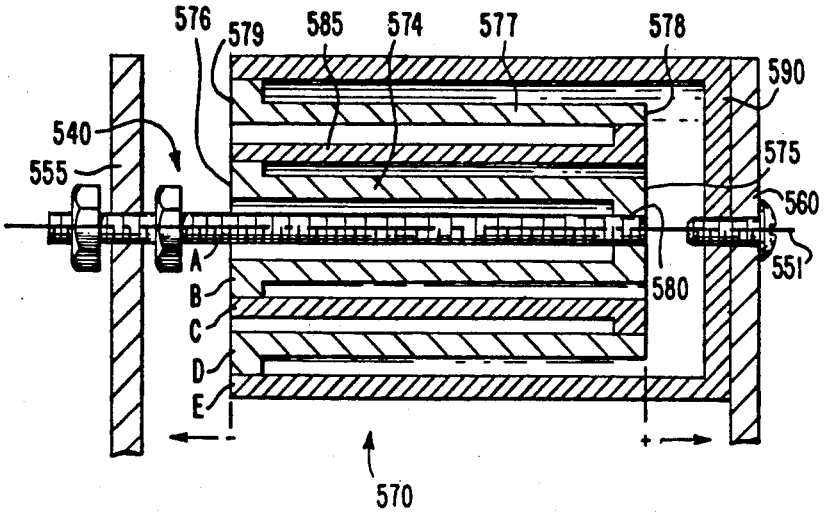
FIG. 5 is a cross-sectional view of a double-stage version of the FIG.-4 assembly.

With reference to the previously-presented comments concerning the symmetrical disposition of the compensation devices, it will be apparent, not only in FIG. 3 but in FIGS. 4 and 5 as well, that for the sake of expositional convenience only one of the typical plurality of such devices has been explicitly illustrated and discussed.

b. Characteristic Inverse Variation:

A presentation of the more-descriptive aspects of an embodiment of the present invention may begin by noting that it is intended to be implemented in the same type of particularized environment as that which was generally specified for the prior art configuration of FIG. 3. As previously discussed, this four-featured environment includes (1) a propagational axis, (2) characteristic longitudinal and transverse geometries, (3) endplate and side-wall component elements of the cavity walls and (4) the longitudinal, intra-side-wall disposition of a transverse current null. It is to be noted supplementally that a complete description of the following inverse-adjustment mechanism will be further expedited by explicitly stating that the previously-described, longitudinally-disposed side walls not only have an intrinsic longitudinal extent but also possess a transverse configuration which establishes the resonator's associated characteristic transverse extent.

In this more-specific environment, an embodiment for the characteristic-compensation devices may be generally described as encompassing thermally-responsive, inverse characteristic-adjustment mechanisms which are operatively associated with the end plates and whose function is to vary the resonator's characteristic longitudinal extent so as to compensate for thermally-induced variations in the resonator's characteristic transverse extent.

It is well known in the art that an increase in the dimensions of a microwave cavity will substantially reduce the resonant frequency of the cavity, and a decrease in cavity dimensions will substantially increase the resonant frequency of the cavity. Thus, by inducing changes in the longitudinal dimensions of a cavity which substantially compensate for other thermally induced changes in cavity dimensions, overall cavity dimensions remain substantially constant in spite of changes in the thermal environment, and consequently, the resonant frequency of the cavity remains substantially constant. As mentioned above, the adjustment mechanism is configured so that the affirmatively-induced longitudinal variations are inversely proportional to the thermally-occurring transverse variations.

Before proceeding with the description of the embodiment having inverse temperature compensation, it will be noted here parenthetically that the employment of the inverse characteristic-adjustment mechanisms for thermal-compensation purposes may be viewed as merely a specialized application of a more-general combination in a first aspect of which the inverse mechanism generically provides, within the described specific environment, the capability of varying the resonator's characteristic longitudinal extent so as to establish an inversely-proportional relationship between the longitudinal variations induced by the adjustment mechanism itself and thermally-induced variations in the resonator's overall characteristic geometry. For the sake of completeness it may also be noted parenthetically that a second aspect of this more-general combination would typically be a current-null segmentation of the type which will presently be described below.

The current-null segmentation for this embodiment of the characteristic-compensation devices resembles that of the prior art configuration in that it is to once again absorb thermally-induced longitudinal variations in the described side-wall extent. There is for this embodiment of the present invention, however, a supplemental requirement that the segmentation also absorb those longitudinal variations in the overall resonator's characteristic extent which are induced by the adjustment mechanism. Also, just as the segmentation's dimensional absorptions for the prior art configuration were such as to not in themselves alter the resonator's characteristic longitudinal extent, so also is the supplemental absorption of characteristic longitudinal variations to not in itself be the cause of a further alteration of the resonator's characteristic longitudinal extent.

An example realization of a thermally-compensated microwave resonator mechanized as an implementation of the present embodiment is presented in FIG. 4. It will become apparent that the thermally-compensated resonator 400 of FIG. 4 possesses with respect to cavity 410 the same particularized features and properties as those which were specified to be part of the cavity of the first-described configuration of FIG. 3. The cavity 410 is thus again arranged so that the propagational axis 450 is a substantially straight line and so that the end plates 455 and 465 are orthogonally-disposed with respect to the propagational axis. The cavity again includes side walls 465 into which has been formed the current-null segmentation 405. In supplemental contrast with the specific embodiment of the first configuration, however, it will prove to be convenient to the below-presented, more detailed description of the inverse adjustment mechanism to generally identify end plates 460 and 455 as being respective first and second end plates.

i. Unitary differential compensation: For a microwave resonator as now particularized, it may be stipulated that the inverse characteristic-adjustment mechanism includes at least one differential-assembly unit. Each such unit is to include two elements: The first is thermally-responsive and has a longitudinal extent which (a) terminates in opposite first and second ends and (b) is longitudinally disposed with respect to the described propagational axis. In this longitudinal disposition, the first end is required to be disposed toward the first end plate while the second end is required to be disposed toward the second end plate. The second of the elements is a thermally-nonresponsive mechanism which in turn performs two functions: (a) It holds the first longitudinal end in thermally-invariant relationship with the second end plate and (b) it holds the second longitudinal end in thermally-invariant relationship with the first end plate.

As specifically realized in the resonator of FIG. 4, the differential-assembly appears as general element 470. This assembly 470 then includes, as the thermally-responsive element, the temperature-sensitive component 473. Component 473 can be seen to be longitudinally disposed with respect to propagational axis 450 and hence possesses the illustrated longitudinal extent terminating in opposite ends 471 and 472. End 471 is conveniently regarded as the first longitudinal end, with end 472 then becoming the associated second longitudinal end. First end 471 can be seen to be disposed toward the first end plate 460, with second end 472 being consequentially disposed toward the second end plate 455.

The thermally-nonresponsive portion of the differential assembly can be seen to be implemented in two sections. The first is a thermally-invariant bar 480 having opposite first and second ends 481 and 482. The second is a yoke 490 having opposite first and second ends 491 and 492.

It is apparent that with the invariant bar's first end 481 being secured to first longitudinal end 471 and with opposite end 482 being secured to end plate 455, first end 471 is held as required in thermally-invariant relationship with the second end plate 455. It is similarly apparent that with first end 491 of thermally-invariant yoke 490 being secured to the first end plate 460 and with opposite yoke end 492 being secured to second longitudinal end 472, end 472 is held as required in thermally-invariant relationship with the first end plate 460.

In view of these thermally-invariant mountings, it becomes consequentially apparent that thermal variations in element 473 produce a relative motion of first end plate 460 with respect to second end plate 455, with the resulting variation in the characteristic longitudinal extent of cavity 410 being absorbed as required by the current-null segmentation 405. It is further consequentially apparent that the differential nature of this configuration causes a contraction in cavity characteristic length when ambient thermal variations otherwise produce an expansion in thermally-sensitive element 473. A cavity expansion under circumstances of element-473 contraction is produced otherwise.

Thus it can be seen that the configuration of element 473 with thermally-invariant bar 480 and yoke 490 results in differential assembly 470 which has an effective negative coefficient of thermal expansion. By this is meant that in response to a temperature increase, assembly 470 causes a reduction or decrease in the spacing between end plates 455 and 460. Although none of the individual elements has a negative coefficient of thermal expansion, assembly 470 functions as effectively having a negative coefficient of thermal expansion because of its mechanical configuration. Thus, assembly 470 provides an inverse variation in the longitudinal spacing of end plates 455 and 460. When the environment temperature increases, the end plate longitudinal spacing decreases and vice versa.

For the ultimate purpose of thermal compensation for the overall resonator, it is important to now note that the illustrated resonator 400 possesses no special mechanism for counteracting thermally-induced variations in the *transverse* geometry of cavity 410. There would thus tend to be a direct, rather than inverse, variational relationship between changes in ambient temperature and net changes in the subject transverse geometry. It is therefore finally apparent that because the otherwise unrestrained thermally-induced *direct* variations in the transverse geometry of cavity 410 may be offset by appropriately-adjusted thermally-induced *inverse* variations in the cavity's longitudinal extent which are brought about by means of the differential expansion mechanism 470, the desired characteristic compensation for the overall resonator can be achieved through the resulting inversely-proportional relationship.

In an actual mechanization, complementary portions **473*a* and 473*b* of the thermally-responsive element may be implemented by means of a cylinder assembly. Typically, a closed end of the cylinder could be employed as the first longitudinal end 471 of the thermally-responsive element 473, in which case element ends 471*a* and 471*b* would together make up respective portions of the cylinder bottom. The associated opposite end of the cylinder would in an analogous fashion become the second longitudinal end 472 of the thermally-responsive element 473 and would in turn include end portions 472*a* and 472*b*. Similarly, yoke 490 could also be implemented by means of a thermally-invariant cylinder assembly having a closed end which could be employed as a first cylinder end which is to be disposed toward and secured to first end plate 465. In correspondence with the yoke features illustrated in FIG. 4, this first cylinder end would encompass illustrated yoke end 491. Such a cylinder would inherently possess an opposite second end which in this situation would coincide with yoke end 492, would be disposed toward second end plate 455 and would be secured to the second longitudinal end 472 of the thermally-responsive cylinder assembly previously described. The thermally-invariant bar 480 could then be regarded as having its first end 481 secured to the cylinder portions 471*a* and 471*b* and as having its opposite, second end 482 secured to the second end plate 455**.

ii. Multiple differential compensation: In order to provide the resonator with an additional degree of differential inverse adjustment, the unitary element 473 of FIG. 4 may with appropriate modifications to yoke 490 be expanded into a multiple-stage assembly such as the example mechanism 570 illustrated in FIG. 5.

As a supplement to the previously-presented comments concerning the generic inverse-variational capabilities of the overall inverse-adjustment mechanism, it may be noted parenthetically that the added degree of adjustment achievable by the multiple-stage mechanism will make possible the performance of additional specific functions. Thus in addition to utilizing the inverse-relationship capability to realize an *equalizing* compensation effect, it may also for example be employed to achieve within the associated resonator a de-equalizing *overcompensation* in response to thermally-induced changes in general cavity geometry.

With respect again to example mechanism 570, it may also be noted parenthetically that three such units peripherally-spaced at 120° intervals would again typically be employed to provide parallel-plate compensation for a typical cylindrical resonator. It may be further noted that the general associated cavity could be the same as those presented in the previous figures. Accordingly, only those cavity wall portions 555 and 560 which are adjacent to the end-plate mechanism will be included in the discussion here.

This particular version of the inverse-adjustment mechanism may be seen to include thermally-invariant bar assembly 580 in conjunction with thermally-invariant yoke assembly 590. Both of these assemblies correspond to the analogous elements in FIG. 4 and hence will not be further discussed. It will also become apparent that because the adjustment components below bar assembly 580 correspond to those above and because these lower components may be taken as forming in a specific embodiment complementary portions of cylinder assemblies which may be utilized to specifically implement the additively-configured mechanism to be described below, these components will likewise not be further discussed in the present portion of the specification.

(a) Thermally-responsive sub-elements: Considered as a specialized form of the thermally-responsive element described in conjunction with element 473 of FIG. 4, and described in particular with respect to the specific mechanization presented in FIG. 5, this embodiment may in general terms be regarded as including a plurality of additively-configured, paired first and second thermally-responsive sub-elements. In the example mechanization of FIG. 5, the plurality is seen to consist of a single pair of sub-elements, these being sub-elements 574 and 577. Each of these sub-elements is seen to possess, with respect to the resonator disposed out of the field of view, longitudinal extent terminating in opposite first and second intermediate ends. The first intermediate end of sub-element 574 is portion 575, while the second intermediate end of the same sub-element is portion 576. The first intermediate end 575 is seen to be disposed toward first end plate 560, with second intermediate end 576 being analogously disposed toward second end plate 555. Sub-element 577 similarly possesses respective first and second intermediate ends 578 and 579 themselves respectively disposed toward first and second end plates 560 and 555.

For the sake of generality, it will subsequently become convenient to more explicitly regard each sub-element pair as having a first pair member and a second pair member. In the illustrated embodiment, sub-element 574 may be regarded as the first member of the pair, with sub-element 577 then becoming the associated second member of the pair.

It will further become convenient to regard each plurality of paired sub-elements as having a first plurality member and a last plurality member. For the specific situation illustrated in which there is only one pair of sub-elements, the first plurality member becomes the same as the first pair member 574 and the last plurality member consequentially becomes the same as the second pair member 577. In the more-general case, where there may be additional pairs of sub-elements specifically configured in a manner analogous to that illustrated in FIG. 5, the member attached to bar assembly 580 would be the associated first plurality member while the final pair member attached a yoke assembly 590 would become the analogously-associated last plurality member.

For the sake now of the generalized situation in which the multiple inverse assembly is again considered as a specialized case of the unitary assembly, terminological consistency in relation to the basic thermally-responsive element previously described in conjunction with element 473 of FIG. 4 is preserved by designating the first intermediate end of the first pair member of the first plurality member as being the same as the first end of the previously-described thermally-responsive element, and in analogous fashion, the second intermediate end of the second pair member of the last plurality member as coinciding with the second end of the previously-described thermally-responsive element. As specifically applied to the illustrated apparatus, first intermediate end 575 of the first pair member 574 may thus be taken as corresponding to the first end 471*a* of the thermally-responsive element 473 of the unitary configuration in FIG. 4. Similarly, the second intermediate end 579 of the second pair member 577 may be regarded as corresponding to the second end 472*a* of the element 473.

The description of the general-case mechanism is completed by noting that in this situation of an additively-configured plurality of paired sub-elements, the successive pairs would be formed by sequentially pairing adjacently-configured sub-elements. Thus, the second pair members of the first pair of the plurality and of any remaining plurality pairs would become the respective first pair members of any succeeding plurality pairs. For example, in a situation where the thermally-responsive element included additional pairs of sub-elements, second-pair member 577 would become the first pair member of the next succeeding plurality pair.

(b) Thermally-nonresponsive sub-mechanisms: In addition to the above-discussed thermally-responsive sub-elements, a generally-configured, thermally-responsive, multiple differential assembly would include a plurality of thermally-nonresponsive sub-mechanisms, one for each pair of thermally-responsive sub-elements, with each of these sub-mechanisms functioning to hold the second intermediate end of the associated first pair member in thermally-invariant relationship with the first intermediate end of the associated second pair member. As specifically mechanized in the embodiment illustrated in FIG. 5, extension 585 serves in the role of the thermally-nonresponsive sub-mechanism and accordingly holds second intermediate end 576 of first pair member 574 in thermally-invariant relationship with the first intermediate end 578 of the associated second pair member 577. It is apparent that in the generalized situation involving more than one pair of thermally-responsive sub-elements, there would then be, in accordance with the above-stated stipulation, one such thermally-invariant sub-mechanism for each such thermally-responsive pair.

It may be noted in further correspondence to the mechanism of FIG. 4 that the various sub-elements and sub-mechanisms illustrated in FIG. 5 may be analogously implemented as interleaved cylinder assemblies.

3. Transverse Stabilization

Figure 6:
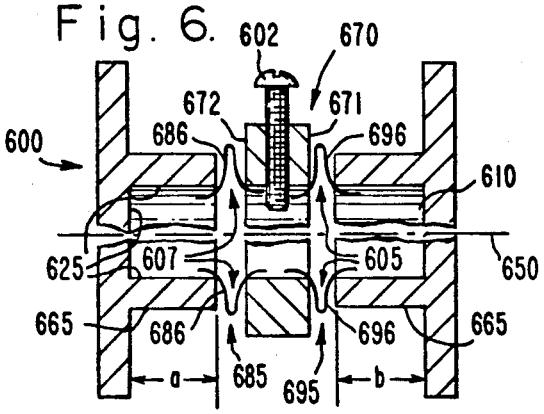
FIG. 6 is a cross-sectional view of a thermally-responsive mechanism for inhibiting thermally-induced variations in a resonator's resonant frequency.

FIG. 6 illustrates an arrangement which may be utilized in conjunction with the previously-described characteristic-compensation devices to provide the resonator's overall thermal-compensation mechanism with the additional capability of counteracting thermally-induced variations in the transverse geometry of the resonator.

The arrangement presented in FIG. 6 resembles those of FIGS. 3 and 4 in that resonator 600 may be more-specifically described as including cavity 610 which is configured such that applied microwave energy is channeled along a propagational axis 650, with cavity 610 possessing in relation to axis 650 both characteristic longitudinal geometry and characteristic transverse geometry. In order to focus on the transverse-stabilization aspects of the present arrangement, it becomes convenient to explicitly specify in addition that the variations which would be counteracted by the characteristic-compensation devices not shown would be variations in the longitudinal characteristic geometry.

In the yet-more-specific operational situation in which the cavity walls 625 are described as including longitudinally-disposed side walls 665 which in themselves have a determinable longitudinal extent such as "a" and "b" and whose transverse configuration establishes the resonator's associated characteristic transverse extent. The illustrated cavity of FIG. 6 includes the thermal stabilization mechanism 670 described hereinafter in more detail. One skilled in the art will appreciate, of course, that a microwave cavity can be equipped with a plurality of such compensation mechanisms. The illustrated cavity of FIG. 6 includes the one such segment 670. A given thermal compensation mechanism 670 would typically be configured as a longitudinally-extending component of the side walls 665 and would typically possess a characteristic transverse configuration the same as that of the side walls. It is further convenient to specify that each such thermal compensation mechanism 670 terminates in opposite first and second ends, ends 671 and 672 as illustrated, and each of the segment ends includes a current-null segmentation, which in the illustrated situation are represented by segmentations 605 and 607. In those instances where cavity 610 possesses an ordinary circular transverse geometry, it becomes convenient to configure stabilization mechanism 670 as a ring with a tuning screw 602 extending therethrough and communicating with the cavity 610. The ring is formed from a material having a relatively high coefficient of thermal expansion. The tuning screw 602 is formed from a material having a relatively low coefficient of thermal expansion. The sidewalls 665 are formed from a material having a coefficient of thermal expansion substantially between the coefficients of thermal expansion of the ring and the tuning screw 602.

The operation of the thermal stabilization mechanism 670 is substantially as follows. For example, as the resonator 600 is exposed to increased thermal energy, the dimensions of its cavity walls 625 tend to increase. As is well known in the art, any increase in the dimensions of the cavity walls 625 generally tends to reduce the resonant frequency of the resonator 600. As the dimensions of the cavity walls 625 increase, however, the dimensions of the ring tend to increase even more rapidly because of its higher coefficient of thermal expansion. The result is that the tuning screw 602, which has the lowest relative coefficient of thermal expansion, effectively is withdrawn from the cavity 610 to such an extent that it substantially compensates for the increased dimensions of the cavity walls 625, and the resonant frequency remains substantially unchanged. As is well known in the art, withdrawal of a tuning screw from a microwave cavity generally tends to increase the resonant frequency of such a cavity.

Thus, the effect of increased thermal energy upon the resonant frequency of the resonator 600 due to increased dimensions of the sidewalls 665 can be substantially offset by the effective substantial withdrawl of the tuning screw 602 from the cavity 610 due to the different coefficients of thermal expansion of the screw 602, the ring and the cavity walls 625.

Conversely, for example, as the resonator 600 is exposed to decreased thermal energy, the dimensions of its cavity walls 625 tend to decrease. As is well known in the art, this decrease in the dimensions of the cavity walls 625 generally tends to increase the resonant frequency of the resonator 600. As the dimensions of the cavity walls 625 decrease, however, the dimensions of the ring tend to decrease even more rapidly because of its higher coefficient of thermal expansion. The result is that the tuning screw 602, which has the lowest relative coefficient of thermal expansion, effectively is extended further into the cavity 610 to such an extent that it substantially compensates for the decreased dimensions of the cavity walls 625, and the resonant frequency remains substantially unchanged. As is well known in the art, extension of a tuning screw further into a microwave cavity generally tends to decrease the resonant frequency of such a cavity.

Thus, the effect of the decreased thermal energy upon the resonant frequency of the resonator 600 due to decreased dimensions of the side walls 665 is substantially offset by the substantial extension of the tuning screw 602 further into the cavity 610.

The screw 602, for example, can be formed from Invar which has a coefficient of thermal expansion of approximately one part per million per degree farenheit (1 ppm/°F.). The ring, for example, can be formed from magnesium which has a coefficient of thermal expansion of approximately 16 ppm/°F. The cavity walls 625, for example, can be formed from aluminum which has a coefficient of thermal expansion of approximately 13 ppm/°F. Alternatively, the cavity walls 625, for example, can be formed from copper which has a coefficient of thermal expansion of approximately 10 ppm/°F.

One will appreciate that movement of screw 602 relative to cavity walls 625 due to changes in the thermal environment of the resonator 600, for example, can be accelerated by incorporating the screw 602 into a differential-assembly element similar to element 470 or a multiple stage assembly similar to example mechanism 570.

As a supplement to the previously-presented comments concerning the external mounting of the characteristic-compensation devices, it may be noted that the transverse-stabilization thermal compensation mechanism 670 is likewise preferrably mounted exterior to the cavity 610 in the sense that element 670 does not protrude into the cavity in a manner which could otherwise once more have an adverse impact on operational characteristics. This non-operationally protruding configuration again enables the cavity to be free from internal obstructions other than the desired tuning elements described below.

It may also be noted that the illustrated situation of FIG. 6 differs from the previously-described embodiments in that it contains two current-null segmentations. Those skilled in the art will recognize that the presence of more than one segmentation is not inconsistent with the requirement that such segmentations be located at current nulls. Because a typical stabilization ring would be rather narrow and because a given null may more-generally be regarded as merely a specific portion of a relatively-wider region of decreased current intensity, the segmentation ends of a given ring could still be expected to be within the low-current region and in this sense satisfy the null-location requirement.

It may be further noted that because such nulls typically occur at half-wavelength intervals along the longitudinal axis of the resonator, a resonator could be designed so as to include several nulls along its characteristic length. It would then be possible, where convenient with respect to alternative configurations in which the resonator generally possessed a plurality of segmentations, to locate the different segmentations at separate ones of these plural nulls.

4. Thermally-Conductive Materials

It will be recalled that an important aim of the present invention is to enable the power-handling capability of microwave resonators to be significantly increased. Because the various above-described forms of the compensation mechanism operate to counteract the thermally-induced dimensional variations which in the past have typically been an unavoidable consequence of any attempt to fabricate the subject resonators from materials with high coefficients of thermal conductivity, the various mechanisms enable the previously-stated aims of the invention to be realized. Hence even though materials such as aluminum, magnesium and zinc have dimensional characteristics which are very temperature-senstive, the present invention enables these highly-thermally-conductive materials to be employed for microwave, narrow-band tuned elements.

5. Microwave Sealing

The current-null segmentation of the present invention typically takes the form of a cavity-wall separation, at which point a flexible or slip joint may be employed to serve as the cross-segmentation connection mechanism for the associated portions of the cavity walls. In many operational situations it further becomes convenient, if not necessary, to provide a mechanism for preventing the leakage through this jointed separation of microwave energy otherwise contained within the resonator. A variety of conventional mechanisms may be utilized to provide this sealing capability. It may be noted that certain kinds of flexible or slip joints may inherently provide a certain degree of such sealing capability. The segmentation apertures of the previously-presented configurations may accordingly be regarded as possessing suitable sealing expedients. Thus as an unillustrated aspect of joint 195 in FIG. 1, and as an illustrated aspect of joint 395 in FIG. 3, of joint 495 in FIG. 4 and of joints 685 and 695 in FIG. 6, the sealing mechanisms schematically appear as respective components 396, 496 and 686 and 696.

6. Tuning Elements

Microwave resonators typically include tuning elements such as conventional screws which are adjustably inserted into appropriate portions of the microwave cavity. In order to provide an added degree of thermal stabilization, it may be specified that the cavity-tuning elements utilized for the thermally-compensated cavities of the present invention be formed from thermally-nonresponsive material such as Invar. Specific examples forms of such thermally-nonresponsive tuning elements appear as elements 102, 103 and 104 of FIGS. 1 and 2, element 302 of FIG. 3, element 402 of FIG. 4 and element 602 of FIG. 6. It may be noted in the context of FIG. 6 that tuning element 602 is more-specifically regardable as a transverse cavity-tuning element in that the one element illustrated is carried on the transverse-stabilization ring 670 between the ring's associated current-null segmentations 605 and 607.

It may be noted further that in addition to providing the cavity itself with the described tuning elements formed of a thermally-non-responsive material, it is also possible to provide the characteristic-compensation mechanisms with a cavity-tuning capability of their own. Such characteristic-tuning devices have been included in the illustrated versions of the resonators presented previously. The tuning devices thus appear as elements 172 and 177 for the associated characteristic-compensation devices 170 and 175 in FIG. 1, as element 340 for compensation unit 370 in FIG. 3, as element 440 for compensation unit 470 in FIG. 4 and as element 540 for compensation unit 570 in FIG. 5. These tuning devices can be seen to include in turn an appropriate conventional combination of a screw and adjustment-nut assembly which, in accordance with the intent of the present invention, is advantageously formed from a thermally-nonresponsive material, once again such as Invar. Thus, for example, characteristic longitudinal tuning for the device of FIG. 3 can be accomplished by adjusting nut 342 on screw 344 and may analogously be accomplished for the resonator of FIG. 4 by adjusting nut 442 and nut 443, both on screw 444.

With regard to the previously-presented comments concerning the example applicability of the subject inventive concepts to a coaxial resonator, it may be noted parenthetically in the present context of thermally-nonresponsive components that, for the sake of enhanced thermal stability, an inventively-configured coaxial resonator would typically employ a center conductor formed from a thermally-invariant material.

II. Mathematical Analyses

Mathematical analyses for typical dimensional and frequency changes to be experienced in example operating situations involving specific embodiments of the various inventive concepts will now be presented.

A. Cylindrical resonator

1. Basic Relationships

The resonant frequency of a cylindrical resonator having diameter D and length L and operating in the $TE_{111}$ mode is given by $$f = \frac{1}{D}\sqrt{139.3\left[\left(\frac{1.841}{\pi}\right)^2 + \left(\frac{D}{2L}\right)^2\right]}\ \text{GHz.} \tag{1}$$

For a typical resonator of $$D = 2.500 \text{ inches} \quad \text{and } L = 2.000 \text{ inches,} \tag{2}$$

the resonant frequency becomes $$f = \frac{1}{2.500}\sqrt{139.3\left[(.34341) + \left(\frac{2.500}{2 \times 2.000}\right)^2\right]}\ \text{GHz.} \tag{3}$$

$$= 4.04476 \text{ GHz.}$$

The temperature variation experienced by microwave hardware in communication spacecraft typically ranges over a ±50° F. interval. The associated induced change in resonator dimensions is given by the equations $$D' = D\,(1+\alpha\cdot\Delta T) \quad \text{and } L' = L(1+\alpha\cdot\Delta T), \tag{4}$$

where D' and L' are the new diameter and length when the expansion coefficient of the material is $\alpha$ and the temperature change is $\Delta T$.

In the specific instance of a silver-plated Invar resonator, the composite expansion coefficient $\alpha$ becomes $2\times(10)^{-6}$ in/in/°F. A 50° F. temperature change would accordingly induce in this Invar resonator the new dimensions of $$D' = 2.500\,(1 + (2 \times (10)^{-6}) \times 50) \tag{5}$$

$$= 2.50025 \text{ inches and}$$

$$L' = 2.000\,(1 + (2 \times (10)^{-6}) \times 50)$$

$$= 2.00020 \text{ inches.}$$

The associated, thermally-altered resonant frequency would then become $$f = \frac{1}{2.50025}\sqrt{139.3\left[(.34341) + \left(\frac{2.50025}{2 \times 2.00020}\right)^2\right]}\ \text{GHz} \quad (6)$$

$$= 4.04437\ \text{GHz}.$$

The net frequency shift would therefore be $$\Delta f = -0.00039\ \text{GHz or } -0.39\ \text{MHz}. \quad (7)$$

In contrast, for resonators or other tuned elements fabricated from lightweight aluminum alloys having an expansion coefficient of $$\alpha = 13 \times (10)^{-6}\ \text{in/in/°F.},$$

the thermally-charged dimensions would become $$D' = 2.50163\ \text{inches and} \quad (8)$$

$$L' = 2.0013\ \text{inches},$$

and the new resonant frequency would be $$f = \frac{1}{2.50163}\sqrt{139.3\left[(.34341) + \left(\frac{2.50163}{2 \times 2.0013}\right)^2\right]}\ \text{GHz} \quad (9)$$

$$= 4.04213\ \text{GHz}.$$

This then represents an uncompensated frequency shift of $$\Delta f = -0.00263\ \text{GHz or } -2.63\ \text{MHz}, \quad (10)$$

which with reference to Equation 7 can be seen to be over six times as large as that for the INVAR resonator.

2. Length Stabilization

For an aluminum resonator whose length is constrained by Invar-rods configured such as the one presented in FIG. 3, but whose diameter is otherwise unconstrained, and given that the Invar rods would possess an expansion coefficient $\alpha = 1 \times (10)^{-6}$ in/in/°F., the thermally-altered dimensions after a 50° F. temperature change would be ti $D' = 2.50163$ inches and (11)

$$L' = 2.00010\ \text{inches},$$

and the associated resonant frequency would become $$f = \frac{1}{2.50163}\sqrt{139.3\left[(.34341) + \left(\frac{2.50163}{2 \times 2.0001}\right)^2\right]}\ \text{GHz} \quad (12)$$

$$= 4.04342\ \text{GHz}.$$

With reference to a non-thermally-altered aluminum resonator, this would represent a net frequency shift of $$\Delta f = -0.00134\ \text{GHz or } -1.34\ \text{MHz}. \quad (13)$$

By comparison to Equation 10, this can be seen to represent a significant improvement in frequency stability compared to an uncompensated all-aluminum resonator.

3. Inverse Variation

When utilizing a differential bar assembly which has been configured in accordance with the principles set forth in conjunction with FIG. 4 and constructed of both Invar and aluminum, an effective expansion coefficient of $$\Delta = -10 \times (10)^{-6}\ \text{in/in/°F.}$$

may be achieved. For the 50° F. temperature change, $$D' = 2.50163\ \text{inches and } L' = 1.99900\ \text{inches}, \quad (14)$$

and the associated resonant frequency would be $$f' = 4.044615\ \text{GHz}. \quad (15)$$

The frequency shift would then be only $$\Delta f = 0.000145\ \text{GHz or } 0.145\ \text{MHz}. \quad (16)$$

By again comparing with Equation 10, this can be seen to be a still-greater improvement in stability compared to an all-aluminum resonator. By comparison also with Equation 7, this can further be seen to represent an improvement even over an all-Invar resonator.

If magnesium instead of aluminum were utilized in the differential assembly, an effective expansion coefficient of $\alpha = -11.4 \times (10)^{-6}$ in/in/°F. could be achieved, and the new 50° F. dimensions would become $$D' = 2.50163\ \text{in and } L' = 1.99886\ \text{in}, \quad (17)$$

resulting in a new resonant frequency of $$f = \frac{1}{2.50163}\sqrt{139.3\left[(.34341) + \left(\frac{2.50163}{2 \times 1.99886}\right)^2\right]}\ \text{GHz} \quad (18)$$

$$= 4.044755\ \text{GHz}$$

and an associated net frequency change of $$\Delta f = -0.0000046\ \text{GHz} = -0.0046\ \text{MHz} = -4.6\ \text{KHz}. \quad (19)$$

It may be observed that for a resonator having a nominal operating frequency of greater than 4 GHz, this net frequency shift of only 4.6 KHz represents an essentially-zero frequency change.

It will be parenthetically apparent that although it is theoretically possible to precisely select an $\alpha$ such that the frequency change is exactly zero, practical considerations such as fabrication tolerances will typically prevent the achievement of this degree of precision.

B. Rectangular resonator

For a rectangular waveguide resonator operating in the $TE_{101}$ mode, the resonant frequency is given by $$f = \sqrt{34.82\left[\frac{1}{A^2} + \frac{1}{L^2}\right]}\ \text{GHz} \quad (20)$$

where A and L are the resonator width and length in inches. If for a typical resonator $$A=0.750 \text{ inches and } L=0.600 \text{ inches,} \quad (21)$$

the resonant frequency then becomes $$f=\sqrt{34.82\left[\frac{1}{(0.75)^2}+\frac{1}{(0.60)^2}\right]}\ \text{GHz} \quad (22)$$

$$=12.59462 \text{ GHz.}$$

In a situation where aluminum is to be employed as the resonator material and a 50° F. temperature increase is experienced, the new dimensions become $$A'=0.7504875 \text{ inches and} \quad (23)$$

$$L'=0.600390 \text{ inches,}$$

and the associated resonant frequency is $$f'=12.58644 \text{ GHz.} \quad (24)$$

In comparison with a non-thermally-altered rectangular resonator, this represents a frequency shift of $$\Delta f=-0.00818 \text{ GHz or } -8.18 \text{ MHz.} \quad (25)$$

Again employing a differential-compensation assembly of Invar and either aluminum or magnesium, with the assembly having been configured to provide an effective expansion coefficient of $\alpha=-8.3\times(10)^{-6}$ in/in/°F., the resulting new dimensions subsequent to a 50° F. temperature increase would be $$A'=0.7504875 \text{ inches and } L'=0.5997510 \text{ inches.} \quad (26)$$

The associated resonant frequency would become $$f'=12.5946171 \text{ GHz,} \quad (27)$$

and the net frequency shift experienced would be $$\Delta f'=-0.0000026 \text{ GHz}=-2.6 \text{ KHz,} \quad (28)$$

or again essentially zero.

C. Multiple differential configuration

A more-generalized type of analysis will now be presented for the gross-level thermally-induced dimensional changes which may be expected to be experienced by an example embodiment of the multiple-differential configuration illustrated in FIG. 5. For the sake of preliminary orientation with respect to imaginary axis 551, changes in the rightward direction will be assiged positive units of measurement while those to the left will be assigned negative units. It may also be noted that it will prove to be convenient to associate simplified identification labels with various components of the illustrated configuration.

With a rise in temperature, the effectively-unrestrained right end of low-expansion element "A" will move one unit ot the right, with attached high-expansion element "B" expanding 16 units to the left. Similarly, low-expansion element "C" will move one unit to the right, the high-expansion element "D" will move 16 units to the left. The right end of low-expansion element "E" will similarly move one unit to the right.

Summing the induced movements gives $$(+1-16+1-16+1)=-29. \quad (29)$$

This means that a temperature rise which would cause the resonator's otherwise-unrestrained diameter to expand would induce the multiple differential assembly to produce a net contraction in resonator characteristic length of 29 normalized units. Through an appropriate application of ordinary design considerations, this net contraction in characteristic length could be utilized in an inverse-compensation manner to balance out the expansion in characteristic diameter so as to produce a net resonant-frequency change of effectively zero.

As a particularized reiteration of the previously-presented comments concerning the generic capabilities of the multiple differential configuration, it may be noted parenthetically that by means of similarly-appropriate adjustments, the net contraction produced by this configuration may also be utilized to achieve an *overcompensation* of the cavity.

The preceding description has presented in detail merely exemplary preferred ways in which the concepts of the present invention may be applied. Those skilled in the art will recognize that numerous alternatives encompassing many variations may readily be employed without departing from the spirt and scope of the invention as set forth in the appended claims, in which:

What is claimed is:

1. A microwave resonator comprising:

a microwave cavity having longitudinal and transverse dimensions, transversely segmented into first and second longitudinal sections for permitting relative longitudinal movement between said first and second longitudinal sections;

longitudinally spaced first and second plates secured to said cavity on the ends of said first and second longitudinal sections opposite the transverse segmentation;

thermally responsive first compensation means secured to said first and second plates; and said first compensation means having an effective negative coefficient of thermal expansion to provide an inverse variation in the longitudinal spacing between said first and second plates;

whereby resonant frequency changes of said resonator resulting from thermally induced variations in the transverse dimensions of said cavity are substantially offset by thermally induced inverse variations in the longitudinal spacing between said first and second plates.

2. The resonator of claim 1, wherein said first compensation means comprises a plurality of substantially elongated members longitudinally disposed between said first and second plates.

3. The resonator of claim 2 wherein each of said elongated members of said first compensation means comprises:

a first expansion member comprising a material having a relatively low coefficient of thermal expansion, said first expansion member having a first portion secured to said first plate;

a second expansion member comprising a material having a coefficient of thermal expansion higher than the coefficient of thermal expansion of said first expansion member, said second expansion member having a first portion secured to a second portion of said first expansion member, said first and second portions of said first expansion member being longitudinally spaced from one another; and a third expansion member comprising a material having a coefficient of thermal expansion substantially lower than the coefficient of thermal expansion of said second expansion member, said third expansion member having a first portion secured to a second portion of said second expansion member, said first and second portions of said second expansion member being longitudinally spaced from one another, said third expansion member having a second portion secured to said second plate, said first and second portions of said third expansion member being longitudinally spaced from one another.

4. The resonator of claim 3 wherein said second portion of said first expansion member and said first portion of said second expansion member are longitudinally spaced from said second plate.

5. The resonator of claim 4 wherein said third expansion member defines a substantially elongated first expansion cavity, said first and second expansion members being substantially disposed within said first expansion cavity; and wherein said second expansion member defines a second expansion cavity, said first expansion member being substantially disposed within said second expansion cavity.

6. The resonator of claim 3 wherein the material of said first and third expansion members is Invar.

7. The resonator of claim 3 wherein the material of said second expansion member is aluminum.

8. The resonator of claim 3 wherein the material of said second expansion member is magnesium.

9. The resonator of claim 1, wherein microwaves propagating in said microwave cavity include at least one propagational current null, and wherein said microwave cavity includes a longitudinal gap at the transverse segmentation, said gap being positioned substantially at the location of said at least one propagational current null.

10. The resonator of claim 1, wherein said microwave cavity has a substantially cylindrical transverse cross-section.

11. The microwave resonator of claim 1, wherein a longitudinal gap is formed between said first and second longitudinal sections by the transverse segmentation, said resonator further including:

a tuning member having a portion extending into said gap in said cavity and being adapted to adjust the resonant frequency of said microwave cavity as said portion of said tuning member moves into and out of said microwave cavity; and thermally responsive second compensation means positioned substantially adjacent said longitudinal gap and surrounding a portion of said cavity for supporting said tuning member and for further compensating for changes in said resonant frequency due to thermally induced changes in microwave cavity dimensions by varying the extent to which said portion of said tuning member extends within said microwave cavity.

12. A microwave resonator comprising:

a microwave cavity traversely segmented into first and second longitudinal sections such that there is a longitudinal gap between said first and second longitudinal sections;

a tuning member hang a portion extending into said gap in said cavity and being adapted to adjust the resonant frequency of said microwave cavity as said portion of said tuning member moves into and out of said microwave cavity; and thermally responsive second compensation means positioned substantially adjacent said longitudinal gap and surrounding a portion of said cavity for supporting said tuning member and for substantially compensating for changes in said resonant frequency of said microwave cavity due to thermally induced changes in microwave cavity dimensions by varying the extent to which said portion of said tuning member extends within said microwave cavity.

13. The resonator of claim 12, wherein said second compensation means comprises a material having a relatively high coefficient of thermal expansion and wherein said tuning member comprises a material having a relatively low coefficient of thermal expansion.

14. The resonator of claim 12, wherein the material of said second compensation means is magnesium and the material of said tuning member is Invar.

15. The resonator of claim 12, wherein the material of said microwave cavity is aluminum.

16. The resonator of claim 12, wherein the material of said microwave cavity is copper.

* * * * *